US006431789B2

(12) United States Patent
Schneider et al.

(10) Patent No.: US 6,431,789 B2
(45) Date of Patent: Aug. 13, 2002

(54) METHOD AND APPARATUS FOR ADJUSTING FIBERGLASS MANHOLES

(75) Inventors: William A. Schneider, Conroe; Robert B. Sergent, Spring; Edgar C. Crosby, Montgomery, all of TX (US)

(73) Assignee: Containment Solutions, Inc., Conroe, TX (US)

( * ) Notice: Subject to any disclaimer, the term of this patent is extended or adjusted under 35 U.S.C. 154(b) by 0 days.

(21) Appl. No.: 09/505,167

(22) Filed: Feb. 15, 2000

Related U.S. Application Data

(60) Provisional application No. 60/127,953, filed on Apr. 6, 1999.

(51) Int. Cl.[7] ..... E02D 29/12; E02D 29/14

(52) U.S. Cl. ..... 404/26; 404/73; 405/133; 405/135; 52/741.7; 52/745.03; 52/20

(58) Field of Search ..... 404/26, 72, 73; 52/19–21, 741.1, 745.02; 405/133, 134, 135

(56) References Cited

U.S. PATENT DOCUMENTS

| | | | | | |
|---|---|---|---|---|---|
| 1,638,495 | A | * | 8/1927 | Frame | |
| 2,050,023 | A | * | 8/1936 | Slayter | |
| 2,270,604 | A | * | 1/1942 | Roemhild | 285/331 X |
| 3,240,133 | A | * | 3/1966 | Ross | |
| 3,331,295 | A | * | 7/1967 | Sorrell | |
| 3,938,285 | A | * | 2/1976 | Gilbu | 52/20 |
| 4,089,139 | A | * | 5/1978 | Moffa et al. | 52/20 |
| 4,275,757 | A | * | 6/1981 | Singer | 52/20 X |
| 5,056,833 | A | * | 10/1991 | Webb et al. | 285/112 |
| 5,360,131 | A | * | 11/1994 | Phillipps et al. | |
| 5,386,669 | A | * | 2/1995 | Almeida | 52/19 |
| 5,564,855 | A | * | 10/1996 | Anderson | 404/26 |
| 5,617,679 | A | * | 4/1997 | Meyers | 52/20 |
| 5,800,143 | A | * | 9/1998 | Bravo | 405/52 |
| 5,852,901 | A | * | 12/1998 | Meyers | 52/20 |
| 5,870,871 | A | * | 2/1999 | Stewart | 52/20 X |
| 6,047,724 | A | * | 4/2000 | Nurse | 52/20 X |
| 6,145,895 | A | * | 11/2000 | Patel et al. | 285/369 |
| 6,164,702 | A | * | 12/2000 | Hauber et al. | 285/21.2 |

FOREIGN PATENT DOCUMENTS

| | | | | |
|---|---|---|---|---|
| DE | 3344134 | * | 6/1985 | 52/20 |
| GB | 22187 | * | 9/1909 | 52/20 |
| GB | 2265174 | * | 9/1993 | 52/20 |
| WO | 91/18151 | * | 9/1993 | 52/20 |

* cited by examiner

*Primary Examiner*—Robert Canfield
(74) *Attorney, Agent, or Firm*—Shaw Pittman LLP

(57) ABSTRACT

A fiberglass manhole adjustment ring comprising a fiberglass pipe and a self-centering lip attached to the edge of the pipe, and a method for installing the fiberglass manhole adjustment ring in an existing fiberglass manhole. The self-centering lip can either be attached to the interior edge of the pipe to form a sleeve or to the exterior edge of the pipe to form a collar. An interior self-centering lip, or sleeve, slides into an adjoining fiberglass manhole section while an exterior self-centering lip, or collar, slides over an adjoining manhole section. The manhole adjustment ring is inserted between the cone section and barrel section of an existing fiberglass manhole to accommodate changes in elevation of the surrounding grade level. The self-centering lip may also be used on manhole sections to enable field assembly of a manhole.

20 Claims, 2 Drawing Sheets

METHOD AND APPARATUS FOR ADJUSTING FIBERGLASS MANHOLES

This application claims the benefit of the filing date of U.S. Provisional Application No. 60/127,953, filed Apr. 6, 1999.

BACKGROUND

FIELD OF THE INVENTION

The present invention relates to fiberglass manholes, and more particularly, to devices and methods for joining fiberglass manhole sections and for adjusting the elevation of fiberglass manholes.

BACKGROUND OF THE INVENTION

Conventional fiberglass manholes are constructed of a cone or corbel section set on top of and fused to a bottom barrel or pipe section. The wide end of the cone section, which sits on the barrel section, and the barrel section are of equal diameter, and have straight edges which mate face to face and flush with each other. In some designs, the mating edge of the cone section has an outer lip that slides around the mating edge of the barrel section. Manufacturers contact the faces of each section together and fuse them with exterior fiberglass lay-ups. Once assembled and fused, the fiberglass manhole is delivered to the utility contractor as a one-piece unit.

Knowing the height of the one-piece structure, a utility contractor typically excavates to a depth slightly greater than the height of the manhole and sets the manhole on the bottom of the excavation so that the top of the cone section resides just below final grade level. The contractor places at least one pre-cast concrete adjustment ring on top of the cone section to properly distribute the load, e.g., highway load, across the cone section. The adjustment ring could also be made of brick. Then, the contractor places a cast iron manhole ring and cover on top of the concrete adjustment ring. Finally, the contractor backfills around the manhole to bring the grade level up to the elevation of the cast iron manhole ring.

Using a single unit manhole greatly simplifies the initial installation. However, after installation, a monolithic fiberglass manhole presents serious difficulties in adjusting the top elevation of the manhole to accommodate substantial changes in the surrounding grade level. The concrete adjustment rings on top of the cone section may be used to accommodate minor variations in grade level, typically at increments of 2 inches. However, because contractors are typically prohibited from stacking the concrete adjustment rings higher than 18 inches, or nine 2-inch rings, the concrete adjustment rings cannot be used to compensate for substantial grade level changes. Further, stacking more than three rings presents considerable drawbacks in handling and assembling the manhole structure.

Thus, to accommodate significant grade level changes, e.g., more than 6 inches, contractors are left with two options. To adjust the elevation of the monolithic fiberglass manhole, the contractor must either replace the manhole with a manhole of a height consistent with the new grade level or cut the manhole and add or subtract sections to match the new grade level.

Replacing the entire manhole requires extensive excavation and is cost-prohibitive. Cutting the manhole reduces the excavation required but creates problems in aligning and rejoining the manhole sections. Unfortunately, field conditions prevent contractors from achieving the accurate joints possible in a factory setting. Often, such attempts at field modification lead to improper joints that are not centered and not bonded well enough to prevent differential movements between the manhole sections.

SUMMARY OF THE INVENTION

The present invention is directed to a fiberglass manhole adjustment ring and a method for installing the ring in existing fiberglass manholes. The adjustment ring is installed between the cone and barrel sections of an existing fiberglass manhole that has been cut in the field.

The following definitions and descriptions are provided to clearly define the invention.

The "cone" or "corbel" is the upper section of the manhole that is positioned with the narrow opening at the top and the wide opening at the bottom. The narrow opening is set just below grade level and receives the concrete adjustment rings and manhole ring and cover. The wide opening joins the lower section of the manhole structure.

The "pipe" or "barrel" section is the lower section of the manhole that is open on one end and closed on the other end to form a container. The open end joins the cone section.

A "self-centering lip" is a strip of fiberglass material adhered to the full circumference of an interior or exterior edge of a manhole section. The lip extends from the edge of the manhole section to form a collar in the case of an exterior lip or a sleeve in the case of an interior lip. An exterior lip fits around an adjoining manhole section, while an interior lip slides into an adjoining manhole section.

In light of the above definitions, the fiberglass manhole adjustment ring includes a section of fiberglass pipe with an interior or exterior self-centering lip attached to one or both ends of the pipe. The diameter of the fiberglass pipe is equal to the diameter of the barrel section. The length of the pipe is dependent upon the required change in elevation of the manhole.

The length and thickness of the interior or exterior lip depend upon the diameter of the adjustment ring and the pipe section. The larger the diameter, the greater the possibility of high lateral forces, and the thicker and longer the lip has to be. The lip must provide a tight, centered fit to resist any movement between the manhole sections.

Depending upon the type of construction of the existing manhole, self-centering lips may be needed on both sides of the adjustment ring. If the originally manufactured cone and barrel section of the manhole are joined without self-centering lips, then both sides of the adjustment ring must be fitted with any combination of interior and exterior self-centering lips. In this manner, when the cone and barrel section are cut and separated, they are rejoined by sliding the lips on either side of the adjustment ring into or around both the cone and barrel sections. If either the cone or barrel section was manufactured with a self-centering lip, a self-centering lip on the adjustment ring is unnecessary because the adjustment pipe section, matching the original diameter of the cone or barrel section, will slide inside or around the original self-centering lip.

Turning to the method of installation, a contractor first cuts the factory-applied exterior fiberglass lay-up located where the barrel and cone sections meet. The cut must be just deep enough to sever the lay-up and allow removal of the cone section. If the existing manhole was manufactured with an exterior self-centering lip, the contractor uses that lip as a guide to cut through the exterior lay-up. After cutting the lay-up and removing the cone section, the contractor installs the manhole adjustment ring by sliding the ring self-centering lip around or inside the exposed barrel section. The contractor then sets the original cone section on top of the adjustment ring to complete the re-assembly. Finally, the contractor bonds the sections together with, e.g., fiberglass lay-ups on the exterior manhole surface centered over each new joint.

One skilled in the art would readily understand how to use multiple adjustment rings in varying heights to reach a desired elevation. Further, varying constructions of existing manholes would necessitate multiple combinations of adjustment ring end fittings, i.e., interior or exterior self-centering lips. Also, various means of attaching the self-centering lip to the adjustment ring are possible, e.g., pop rivets, bolts, and fiberglass molding that allows for the use of a rubber, cork, or caulk gasket. Finally, any number of methods of bonding the sections could be used to satisfy site condition requirements or municipal specifications, e.g., molding a self-centering lip channel that allows adhesive to be placed in the channel, using epoxy, using adhesives, applying shrink-wrap, or clamping a rubber gasket in place with worm drive clamps.

In another embodiment of the present invention, self-centering lips are provided on manhole sections to enable a contractor to erect a manhole in the field, as opposed to receiving a factory assembled single-piece unit. In this manner, a contractor sets the barrel section, connects and grouts the pipe entering the barrel section, and grouts the invert inside the base of the barrel section before the remaining manhole sections are set on top of the barrel section. With the aid of self-centering lips, the sections are joined using the same method for installing the fiberglass manhole adjustment rings. A preferred mode of joining and bonding the manhole sections uses a fiberglass adhesive channel and self-centering lip molded to the interior or exterior top edge of the barrel section. As an alternative to the fiberglass adhesive channel, other preferred embodiments bond the sections using a shrink-wrap, a rubber gasket with clamps, an epoxy, or an adhesive.

Allowing the contractor to assemble the manhole in the field avoids the confined-space work otherwise required by conventional single-piece fiberglass manholes. With single-piece fiberglass manholes, contractors must set the manhole and descend into its narrow confines to connect the pipe and form the invert. This confined-space work deep within the manhole burdens the contractor with the cost of providing safety equipment, e.g., tripods, harnesses, and respiratory protection, and the cost of reduced productivity in implementing safety procedures. To eliminate these added costs, the manhole sections with self centering lips allow the contractor to lean over the edge of the barrel section and complete the pipe and invert work from the outside, before the remaining manhole sections are joined to the barrel section.

Accordingly, it is an object of the present invention to provide a device and installation method that facilitates easy adjustment of the height of an existing fiberglass manhole without compromising the quality of the manhole construction.

It is another object of present invention to provide a device and installation method that facilitates field assembly of a fiberglass manhole.

These and other objects of the present invention are described in greater detail in the detailed description of the invention, the appended drawings and the attached claims.

DETAILED DESCRIPTION OF THE INVENTION

Figure 1:
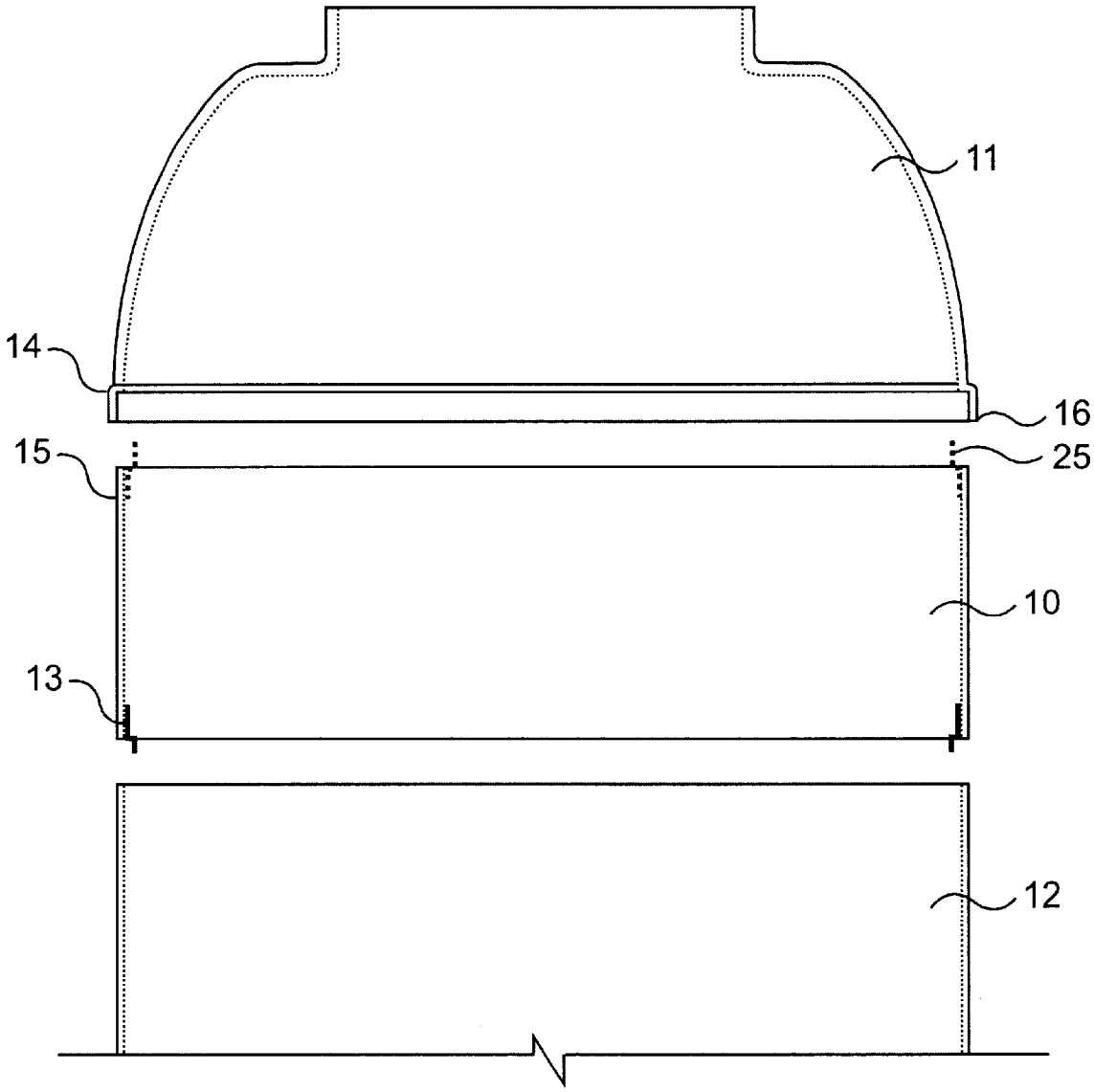
FIG. 1 is an exploded view of a manhole with an adjustment ring using an interior self-centering lip.

Referring to the drawings, the present invention comprises an apparatus and method for adjusting fiberglass manholes using fiberglass manhole rings with self-centering lips.

As shown in FIG. 1, in the preferred embodiment of the present invention, the manhole adjustment ring 10 comprises a fiberglass pipe 15 and an interior self-centering lip 13. The interior self-centering lip 13 is attached to the interior of the fiberglass pipe 15 and extends beyond the edge of the fiberglass pipe to a distance sufficient to withstand lateral forces. The interior self-centering lip 13 is attached around the circumference of the fiberglass pipe 15 and, because it is attached to the interior of the fiberglass pipe 12, is of a diameter slightly smaller than the diameter of the fiberglass pipe 12. As a result, the interior self-centering lip 13 can slide inside the barrel section 12 to provide a tight, centered fit.

FIG. 1 also shows cone section 11 with an exterior self-centering lip 14. This exterior self-centering lip 14 was provided on the originally manufactured fiberglass manhole and is re-used to slide over the top edge of the manhole adjustment ring 10 in a tight, centered fit.

Figure 2:
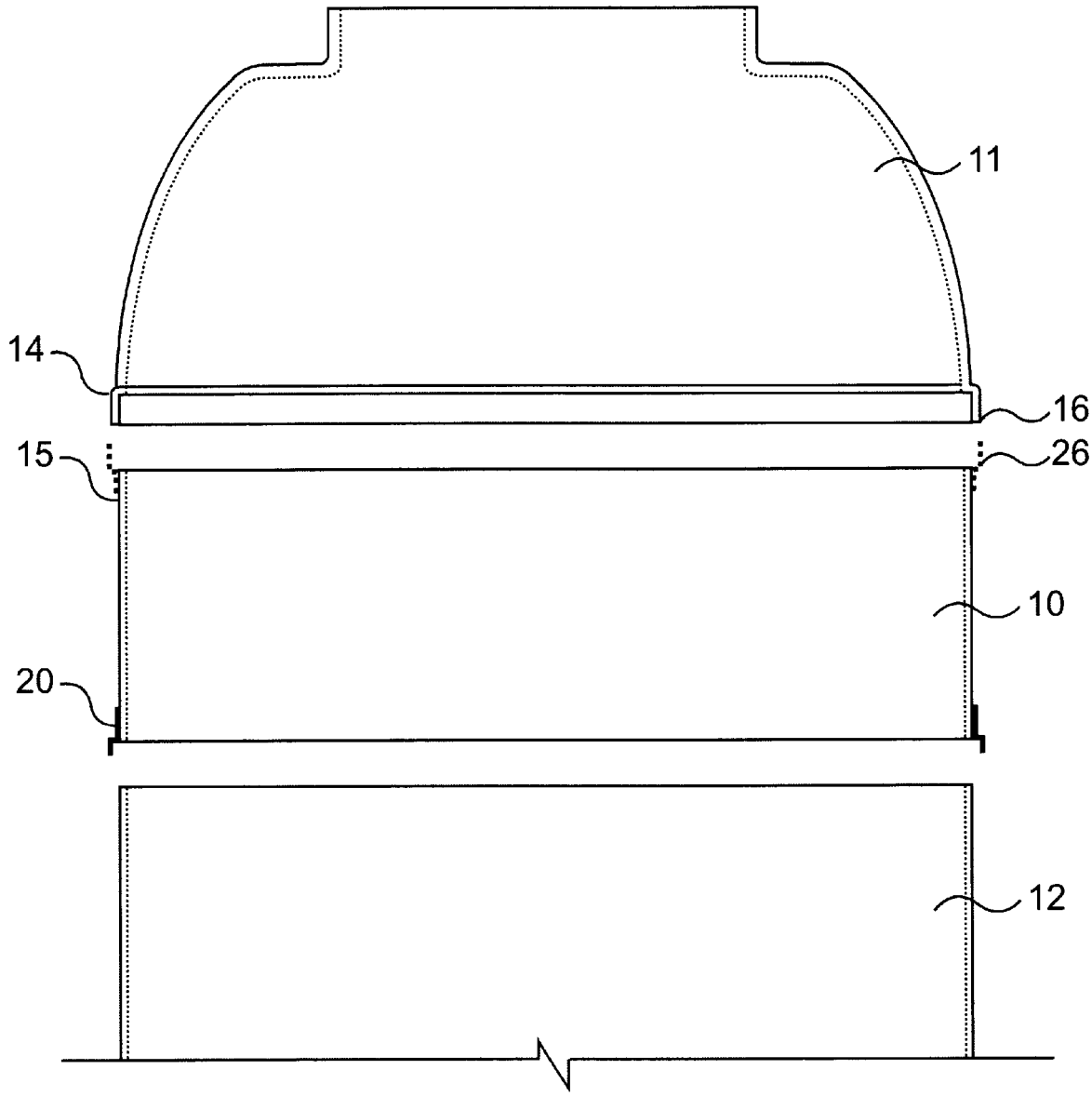
FIG. 2 is an exploded view of a manhole with an adjustment ring using an exterior self-centering lip.

The preferred embodiment uses interior self-centering lips on the manhole adjustment ring 10 because an interior self-centering lip 13 leaves a flush exterior joint on which exterior fiberglass lay-up is more easily applied. However, an exterior self-centering lip 20 as shown in FIG. 2 can also be used. The exterior self-centering lip 20 is attached around the circumference of fiberglass pipe 15 and, because it is attached to the exterior of the fiberglass pipe 12, is of a diameter slightly larger than the diameter of the fiberglass pipe 12. As a result, the exterior self-centering lip 13 can slide over the barrel section 12 to provide a tight, centered fit.

In both FIG. 1 and FIG. 2, if the cone section 11 had not been furnished with an exterior self-centering lip 14, an exterior or interior self-centering lip could be added to the top of the manhole adjustment ring 15 to join with the cone section 11.

A self-centering lip can be attached to the manhole adjustment ring 10 in a number of different ways. In the preferred embodiment of the present invention, a fiberglass lay-up is applied to a self-centering lip to secure it to the exterior or interior of the manhole adjustment ring 10. Lay-ups are easily and efficiently used in the manufacturing process. However, other embodiments could use mechanical means to attach a self-centering lip, such as pop rivets or bolts. This mechanical method would better serve field modifications, where the exact height of the manhole adjustment ring could be finalized in the field.

Installing the manhole adjustment ring 10 includes the following steps. First, the existing manhole is cut at the joint between cone section 11 and barrel section 12. The cut severs the exterior lay-up holding the sections together and frees cone section 11. If the existing manhole cone section was furnished with an exterior self-centering lip 14, outer edge 16 of exterior self-centering lip 14 acts as a guide along which the cut is made. Once the lay-up is cut, cone section 11 is removed and placed aside.

Manhole adjustment ring 10 is placed on top of exposed barrel section 12. If manhole adjustment ring 10 is fitted with an interior self-centering lip 13, as shown in FIG. 1, interior self-centering lip 13 slides inside barrel section 12. If manhole adjustment ring 10 is fitted with an exterior self-centering lip 20, as shown in FIG. 2, exterior self-centering lip 20 slides over the edge of barrel section 12.

Previously removed cone section 11 is retrieved and placed on top of manhole adjustment ring 10. As shown in both FIGS. 1 and 2, if cone section 11 is fitted with an exterior self-centering lip 14, exterior self-centering lip 14 simply slides over the top straight edge of manhole adjustment ring 10. If, however, cone section 11 is straight without a self-centering lip, manhole adjustment ring 10 is fitted with an interior or exterior self-centering lip inside or around which cone section 11 fits. For example, if cone section 11 of FIGS. 1 and 2 were straight, manhole adjustment ring 10 could have an interior self-centering lip 25 (FIG. 1) or an exterior self-centering lip 26 (FIG. 2), which are shown with dotted lines to indicate an alternate configuration corresponding to cone section 11's having a straight edge.

With the cone section, manhole adjustment ring, and barrel section assembled, the final step is to hold, or bond, the sections together. In a preferred embodiment of the present invention, exterior fiberglass lay-ups are applied to the joints.

In another preferred embodiment, the method of bonding the sections uses shrink-wrap, e.g., heat shrink-wrap, such as WrapidSeal™ produced by CANUSA of The Woodlands, Tex. According to this method, an installer first cleans the exterior surfaces of the sections in the area of the joints. The installer then applies adhesive all the way around the sections over the joint in a width greater than the width of the heat shrink-wrap. The installer centers the heat shrink-wrap over the joint, applies it to the adhesive around the sections, and overlaps a portion of the heat shrink-wrap. To complete the bonding and sealing of the sections, the installer heats the heat shrink-wrap so that it tightens and securely holds the sections together.

Another preferred embodiment of the present invention bonds the sections using a rubber gasket of a width sufficient enough to cover the joint and to provide areas on either side of the joint over which at least one worm drive clamp can be tightened. The tightened clamps hold the sections together and create a seal, similar to the functioning of a Fernco® flexible coupling.

Another preferred embodiment of the present invention bonds the sections by molding at the joints a centering lip channel in which adhesive can be placed. Finally, another preferred embodiment bonds the sections using an epoxy or an adhesive material.

Using manhole adjustment rings with self-centering lips offers several advantages. First, the height of the manhole adjust ment ring can be customized to accommodate the desired, new grade level. Additionally, multiple manhole adjustment rings can be stacked so that manufacturers can mostly produce standard height rings, making it only necessary to customize the top ring of the manhole assembly.

Second, the fiberglass adjustment rings can compensate for large changes in elevation, far exceeding the adjustment range of concrete adjustment rings placed on top of the cone section. Also, the fiberglass manhole rings are easier to handle and install than the concrete adjustment rings.

Third, the manhole adjustment ring enables contractors to modify existing fiberglass manholes. Previously, contractors were unable to properly rejoin manhole sections in the field. The self-centering lips provide an easy and inexpensive means of ensuring a tight, centered fit that is then secured with, e.g., exterior fiberglass lay-ups.

Finally, the manhole adjustment ring can be fabricated with a variety of different end fittings (interior or exterior self-centering lips) to accommodate a wide variety of existing fiberglass manhole constructions.

The foregoing disclosure of embodiments of the present invention has been presented for purposes of illustration and description. It is not intended to be exhaustive or to limit the invention to the precise forms disclosed. Many variations and modifications of the embodiments described herein will be obvious to one of ordinary skill in the art in light of the above disclosure. The scope of the invention is to be defined only by the claims, and by their equivalents.

What is claimed is:

1. A fiberglass manhole comprising:

(a) at least two sections; and (b) a fiberglass manhole adjustment ring having at least one self-centering lip adhered to a longitudinal surface of the at least two sections, wherein the fiberglass manhole adjustment ring is position between the at least two sections, wherein the at least two sections are bonded to the fiberglass manhole adjustment ring with lay-ups.

2. A fiberglass manhole comprising:

(a) at least two sections; and (b) a fiberglass manhole adjustment ring having at least one self-centering lip adhered to a longitudinal surface of the at least two sections, wherein the fiberglass manhole adjustment ring is positioned between the at least two section, wherein the at least one self-centering lip is attached to the fiberglass manhole adjustment ring by mechanical means.

3. A fiberglass manhole comprising:

(a) at least two sections; and (b) a fiberglass manhole adjustment ring having at least one self-centering lip adhered to a longitudinal surface of the at least two sections, wherein the fiberglass manhole adjustment ring is positioned between the at least two sections, wherein the at least one self-centering lip is attached to the fiberglass manhole adjustment ring by a lay-up.

4. A fiberglass manhole comprising:

(a) at least two sections; and (b) a fiberglass manhole adjustment ring having at least one self-centering lip adhered to a longitudinal surface of the at least two sections, wherein the fiberglass manhole adjustment ring is positioned between the at least two sections, wherein the at least two sections are a cone section and a barrel section.

5. A fiberglass manhole adjustment ring comprising:

(a) a fiberglass pipe section having an inside surface, an outside surface, a first edge, and a second edge;

(b) a self-centering lip circumferentially attached to the fiberglass pipe section at the first edge, wherein the self-centering lip extends beyond the first edge of the fiberglass pipe second to a distance sufficient to withstand lateral forces; and (c) a second self-centering lip circumferentially attached to the fiberglass pipe section at the second edge, wherein the second self-centering lip extends beyond the second edge of the fiberglass pipe section to a distance sufficient to withstand lateral forces, wherein the first self-centering lip and the second self-centering lip are attached to the fiberglass pipe section with fasterners selected from the group consisting essentially of lay-ups, pop rivets, bolts, and fiberglass molding.

6. A method for joining a first fiberglass manhole section to a second fiberglass manhole section, the method comprising:

(a) attaching a separate self-centering lip around a face of the first fiberglass manhole section; and (b) placing the second fiberglass manhole section in tight contact with the attached self-centering lip, wherein attaching the self-centering lip uses a fastener selected from the group consisting essentially of lay-ups, pop rivets, bolts, and fiberglass molding.

7. A method for installing a fiberglass manhole adjustment ring in a fiberglass manhole comprising:

(a) cutting the fiberglass manhole laterally to create an upper portion and a lower portion;

(b) removing the upper portion;

(c) setting the fiberglass manhole adjustment ring on top of the lower portion so that a self-centering lip of the fiberglass manhole adjustment ring tightly contacts a longitudinal surface of the lower portion;

(d) setting the upper portion on top of the fiberglass manhole adjustment ring;

(e) bonding the lower portion to the fiberglass manhole adjustment ring; and (f) bonding the upper portion to the fiberglass manhole adjustment ring.

8. The method of claim 7, wherein the fiberglass manhole is cut at a joint between a cone section and a barrel section of the fiberglass manhole.

9. The method of claim 8, wherein the fiberglass manhole is cut through a lay-up.

10. The method of claim 8, wherein the cone section has a second self-centering lip that tightly contacts a longitudinal surface of the fiberglass manhole adjustment ring.

11. The method of claim 7, wherein the self-centering lip is an exterior self-centering lip.

12. The method of claim 7, wherein the self-centering lip is an interior self-centering lip.

13. The method of claim 7, wherein setting the upper portion on top of the fiberglass manhole adjustment ring uses a second self-centering lip of the fiberglass manhole adjustment ring to tightly contact a longitudinal surface of the upper portion.

14. The method of claim 13, wherein the second self-centering lip is an exterior self-centering lip.

15. The method of claim 13, wherein the second self-centering lip is an interior self-centering lip.

16. The method of claim 7, wherein setting the upper portion on top of the fiberglass manhole adjustment ring uses a self-centering lip of the upper portion to tightly contact a longitudinal surface of the fiberglass manhole adjustment ring.

17. The method of claim 16, wherein the self-centering lip of the upper portion is an exterior self-centering lip.

18. The method of claim 16, wherein the self-centering lip of the upper portion is an exterior self-centering lip.

19. The method of claim 7, wherein the fiberglass manhole is cut through a lay-up between the upper portion and the lower portion.

20. The method of claim 7, wherein bonding the upper portion to the fiberglass manhole adjustment ring, and bonding the lower portion to the fiberglass manhole adjustment ring use a bond selected from the group consisting essentially of a lay-up, a shrink-wrap, a rubber gasket with clamps, a molded centering lip channel with adhesive, an epoxy, and an adhesive.

* * * * *